United States Patent [19]

Lam

[11] Patent Number: 4,488,727

[45] Date of Patent: Dec. 18, 1984

[54] BOARD GAME HAVING ROCK, SCISSORS, PAPER TYPE THEME

[76] Inventor: Roger K. Lam, 11889 Dogwood Ave., Fountain Valley, Calif. 92708

[21] Appl. No.: 439,179

[22] Filed: Jan. 7, 1983

[51] Int. Cl.[3] ..... A63F 3/00

[52] U.S. Cl. ..... 273/236

[58] Field of Search ..... 273/236, 288, 255, 273, 273/274, 120 R, 260, 261, 241

[56] References Cited

U.S. PATENT DOCUMENTS

| | | | |
|---|---|---|---|
| 2,355,927 | 8/1944 | Scofield | 273/236 |
| 3,048,402 | 8/1962 | Schaper | 273/120 R |
| 4,327,919 | 5/1982 | Vennor | 273/236 |

*Primary Examiner*—Richard C. Pinkham

*Assistant Examiner*—Matthew L. Schneider

*Attorney, Agent, or Firm*—Allen A. Dicke, Jr.

[57] ABSTRACT

Game apparatus comprises a game board together with a plurality of playing pieces each coded to indicate its attribute and value. Three playing pieces of different attributes and different values are stacked to comprise a playing unit. Two players compare the attributes and values of the bottom-most piece of their playing units successively in a number of plays in order to determine the outcome of the game. The game comprises three different groups of attributes having strengths that allow a first group to be stronger than a second, the second group to be stronger than a thrid and the third group to be stronger than the first. In addition, each of the groups of attributes contains three hierarchically ranked groups of different values.

8 Claims, 6 Drawing Figures

BOARD GAME HAVING ROCK, SCISSORS, PAPER TYPE THEME

BACKGROUND

This invention relates to a game, and more particularly to a game in which a game board and a plurality of playing units are utilized for each of two sides each of which consists of only one player.

There are a number of games of skill which incorporate playing apparatus which can be employed by two players in a contest to win the game. One type of game employs a plurality of units of playing pieces, with each of the units having three playing pieces of varying strength. The first piece is stronger than the second; the second is stronger than the third; and the third is stronger than the first. A player arranges these pieces in an order unknown to his opponent. In a turn of play, the player and his opponent both uncover one of the pieces of the unit to determine which is stronger. Games of this general nature are shown in Vennor U.S. Pat. No. 4,327,919 and Schaper U.S. Pat. No. 3,048,402. Such a game is fast and easy but requires skill in choosing the correct order of playing pieces in the units in order to win the game. A game of this type is interesting to players of all ages, but can be made more interesting in the manner described with respect to the preferred embodiment disclosed in this application.

SUMMARY

In order to aid in the understanding of this invention, it can be stated in essentially summary form that it is directed to a game apparatus which employs stacked units of three playing pieces of three different attributes of three different strengths. In addition, each attribute has playing pieces of three different values to increase the number of variations in the stacking of playing units. A game board may be employed with the playing pieces in order to enhance play.

The object of my invention is to provide a game characterized by structural simplicity and readily understandable procedure rules.

Another object of my invention is to provide a game which consists of a game board and fifty-four playing units, in which each of the playing unit consists of three playing pieces; each playing piece is coded with symbol which determines the attribute and value of one the three different related groups of attribute. Within each group, there are three members each of which is assigned a value of high, medium or low.

A further object of my invention is to provide a game with playing units that are composed of playing pieces in which the attribute and value of each playing unit can be altered by rearranging the playing pieces. Success in playing the game depends on a combination of chance and the ability to predict the play of the opponent.

Other features and advantages of the invention maybe readily ascertained by referring to the following description and appended illustrations.

DESCRIPTION OF THE PREFERRED EMBODIMENT

Figure 1:
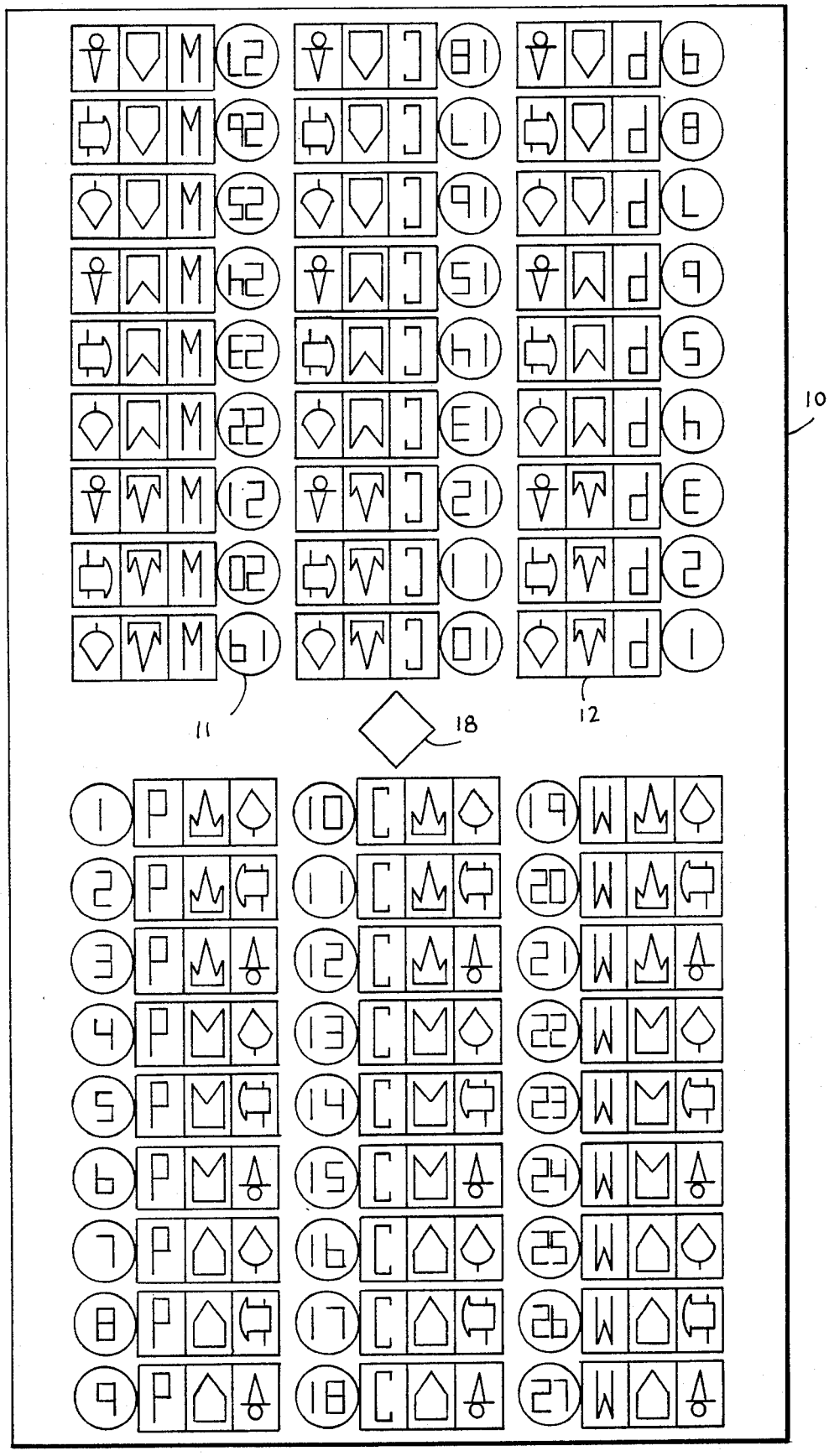
FIG. 1 is a plan view of a playing board according to the invention.

In the embodiment selected for illustration, FIG. 1 shows the top face of a game board 10 which contains twenty-seven circles on each side. Each circle 11 contains a number of a whole number series beginning with one and ending with twenty-seven. The three rectangles 12 adjacent to each circle 11 show the three coded symbols which correspond to the three playing pieces 51, 52, 53 of a same playing unit 61. The diamond 18 in the center is provided for the playing unit 61 of the player who calls the play.

The playing units are each comprised of three separate playing pieces. Each playing piece is marked with one of the nine different symbols. There are three different groups of related symbols, with related group attributes. Each group consists of three members, each of which has an assigned value ranging from high to medium to low.

Figure 2:
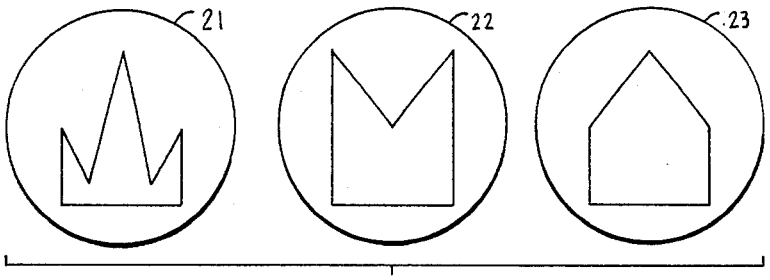
FIG. 2 is a plan view of three playing pieces each of which is coded with a symbol to represent the three members in Group A, namely, the hunters.

The three playing pieces each with a coded symbol appearing in FIG. 2 represent the three members of the hunters in Group A. The symbols represent a king 21, a squire 22, and a yeoman 23. Of the three pieces, the king 21 has the highest value. A squire 22 has a higher value than a yeoman 23.

Figure 3:
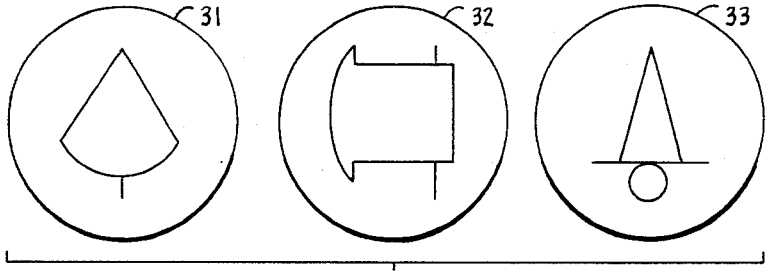
FIG. 3 is a plan view of the three playing pieces each of which is coded with a symbol to represent the three members in Group B, namely, the weapons.

The three playing pieces each with a coded symbol appearing in FIG. 3 represent the three members of the weapons in Group B. The symbols represent a spear 31, an axe 32, and a dagger 33. Of the three pieces, the spear 31 has the highest value. An axe 32 has a higher value than a dagger 33.

Figure 4:
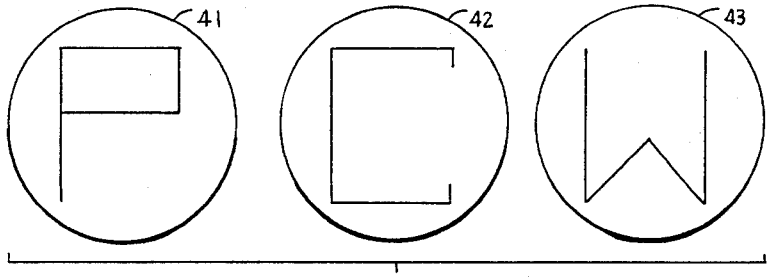
FIG. 4 is a plan view of the three playing pieces each of which is coded with a symbol to represent the three members in Group C, namely, the animals.

The three playing pieces each with a coded symbol appearing in FIG. 4 represent the three members of the animals in Group C. The symbols represent a panther 41, a cheetah 42, and a wolf 43. Of the three pieces, the panther 41 has the highest value. A cheetah 42 has a higher value than a wolf 43.

Figure 5:
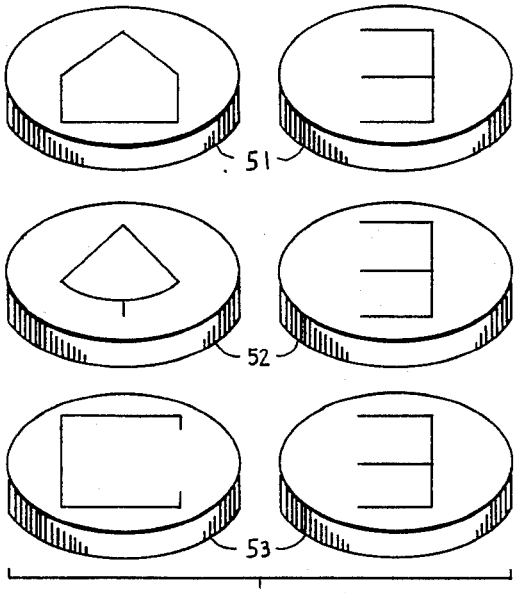
FIG. 5 is a perspective view of an example of the top and bottom of three playing pieces which comprise one playing unit.
Figure 6:
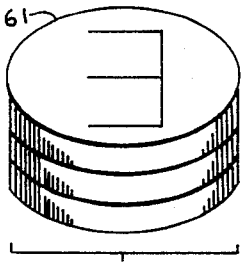
FIG. 6 is a perspective view of an example of one of fifty-four playing units. Each playing unit is comprised of three playing pieces.

The three playing pieces 51, 52, 53 illustrated in FIG. 5 are samples of the components of a playing unit 61, in which the playing unit 61 is illustrated in FIG. 6. A playing unit 61 must consist of three playing pieces 51, 52, 53, having each playing piece coded with a symbol to represent its attribute and value; all the three different, related groups of attributes are being symbolized in each playing unit 61.

While one side of the playing piece is coded with a symbol to indicate its attribute and value, the reverse side is coded with a number; playing pieces 51, 52, 53 of the same playing unit 61 carry a same number, so that players can assemble the playing units with correct playing pieces 51, 52, 53. The whole number series which begins with one and ends with twenty-seven also serves to indicate which circle 11 that the playing unit 61 is placed upon.

There are twenty-seven playing units provided for each of the two players. Since each playing unit 61 consists of three playing pieces 51, 52, 53; each player is provided with a total of eighty-one playing pieces. Since there are three groups of attributes with three members each, there is a total of nine members from the three different, related groups of attributes. Each of the nine members of the three groups is represented nine times.

The fifty-four coded playing units are placed on the corresponding circles with their coded symbols face down against the game board 10. The purpose is to hide the symbols from the opponent. The symbol in contact with the board represents the attribute and value of the playing unit 61.

In this game any one member of the hunters in Group A, which includes the king 21, the squire 22, and the yeoman 23 has an attribute which is superior to any of the members of the weapons in Group B which includes the spear 31, the axe 32, and the dagger 33. Any one member of the weapons in Group B which includes the spear 31, the axe 32, and the dagger 33 has an attribute which is superior to any of the members of the animals in Group C, which includes the panther 41, the cheetah 42, and the coyote 43. Further more, any one member of the animals in Group C, which includes the panther 41, the cheetah 42, and the coyote 43 has an attribute which is superior to any of the members of the hunters in Group A which includes the king 21, the squire 22, and the yeoman 23. Thus, the three groups constitute a circular pattern of relationships, such that each member of Group A has an attribute superior to any member of Group B, and each member of Group B has an attribute superior to any member of Group C, and each member of Group C has an attribute superior to any member of Group A.

The play begins by putting all the playing units on the game board 10 with symbols face down. The two opposing players take turns in calling the play, the object of which is to try to capture the opponent's playing unit. Before the play begins, players are allowed to rearrange the playing pieces within each playing unit. The bottom playing piece always determines the attribute and value of the playing unit. Each playing unit 61 has a different number from one to twenty-seven. When the playing units are being placed on the game board 10, each playing unit 61 must correspond to the number in the circle 11. The first player is the caller. He chooses one of his playing unit 61 and determines the attributes of the playing unit 61 by placing the playing pieces with the appropriate symbol against the diamond 18 of the game board 10. Then the caller will pickup at random a playing unit 61 from his opponent's side and hands it to his opponent. The opponent will then rearrange the playing pieces 51, 52, 53 to determine the attribute of his playing unit 61. Once the decision is made, the playing unit 61 is returned to it's circle 11 with the symbol face up. The caller will then have to show the symbol which determines the attribute of his playing unit 61. The two exposed playing pieces are compared for their attributes, the one with the superior attribute wins the playing unit 61. If the attributes are the same, then the playing pieces are compared for their values. The playing piece with the highest value wins. The winner of the play takes possession of the opponents playing unit 61, and removes it off the game board 10. If the winner is the caller, he returns his own playing unit 61 back to the appropriate circle 11 with the symbol face down, if the winner is the opponent, he turns his playing unit 61 with symbol face down. If the two exposed playing pieces are the same, the play results in a draw, and both players return their playing units back to the appropriate circles, with the symbols face down.

On the next play, the opponent becomes the caller and the previous caller becomes the opponent. Same procedure described above is carried out until one of the player loses all his playing units.

Although the now preferred embodiment of the present invention has been shown and described herein, it is not desired to limit the invention to the exact construction of the playing unit, the groups of attributes, and their members. Accordingly, all suitable modification and equivalents maybe resorted to, falling within the scope of the invention as claimed.

I claim:

1. In a game, the combination comprising:

a game board accommodating two players providing first and second identical patterns having twenty-seven numbers, each number accompanied by symbols arranged in different configurations, with each configuration containing three coded symbols, and each symbol representing one member of three different related groups of attributes, said first and second patterns respectively being arranged on opposite sides of a neutral field; and a plurality of playing units, there being a sufficient number of playing units so that each player is provided with equal and identical sets of playing units, each of said playing units being comprised of three playing pieces, in which all three different related groups of attributes are symbolized in each playing unit, one side of the said playing piece being coded with a number and the other side being coded with the symbol of one of said members, the members of any one group having the same attribute, said attributes comprising a circular pattern consisting of first, second and third attributes, said attributes having magnitudes such that when any two of the three attributes are paired in a challenge, one attribute is always superior to another, such that said first is superior to said second, said second is superior to said third, and said third is superior to said first, so that when any two attributes of the circular pattern are matched, there is always a predetermined winner.

2. The game according to claim 1 in which each member within each of the three groups is assigned a value.

3. The game of claim 1 wherein there is a marking within said neutral field between said sets of pattern for receipt of playing units during play.

4. The game in accordance with claim 1 wherein said twenty-seven numbers are surrounded by a geometric pattern which is the same geometric pattern as said units.

5. The game of claim 1 wherein said symbols are contained within adjacent rectangles in organizations of three.

6. In a game, the combination comprising:

a game board accommodating two players providing each with an identical pattern having twenty-seven encircled numbers, each number accompanied by three rectangles containing a variety of symbols in twenty-seven different configurations, with each configuration containing three coded symbols, and each symbol representing one member of three different related groups of attributes, each member within each of the three groups being assigned a value, said patterns being first and second patterns arranged on opposite sides of a neutral field;

a plurality of playing units, each player having identical sets of playing units, each of said playing units being comprised of three stacked playing pieces, one side of said playing pieces being coded with the symbol of one of said members, said playing pieces in each unit consisting of one member of each group and being stacked with the symbol face down and with a selected attribute on the bottom, wherein the bottom playing piece represents the total attribute and value of the playing unit such that when the bottom playing piece is exposed during play the opposing players can compare the attributes and values of the bottom exposed playing pieces whereby the outcome of the play is determined by the superior attribute or in the event the pieces display the same attribute by the assigned value of the exposed playing pieces.

7. The game of claim 6 wherein there is a marking within said neutral field between said sets of pattern for receipt of playing units during play.

8. The game in accordance with claim 3 wherein said twenty-seven numbers are surrounded by a geometric pattern which is the same geometric pattern as said units.

* * * * *